US007581479B2

(12) United States Patent
Gessler et al.

(10) Patent No.: US 7,581,479 B2
(45) Date of Patent: Sep. 1, 2009

(54) METHOD FOR PRODUCING FIBER COMPOSITE SEMI-FINISHED PRODUCTS BY MEANS OF A ROUND BRAIDING TECHNIQUE

(75) Inventors: Andreas Gessler, Haar (DE); Franz Maidl, Wallerfing (DE)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 10/592,678

(22) PCT Filed: Apr. 6, 2005

(86) PCT No.: PCT/DE2005/000603

§ 371 (c)(1),
(2), (4) Date: Sep. 13, 2006

(87) PCT Pub. No.: WO2005/098117

PCT Pub. Date: Oct. 20, 2005

(65) Prior Publication Data

US 2007/0193439 A1 Aug. 23, 2007

(30) Foreign Application Priority Data

Apr. 6, 2004 (DE) ..... 10 2004 017 311

(51) Int. Cl.
*D04C 1/00* (2006.01)

(52) U.S. Cl. ..... 87/6; 87/9; 87/13

(58) Field of Classification Search ..... 87/6, 87/9, 13

See application file for complete search history.

(56) References Cited

U.S. PATENT DOCUMENTS

| | | | | |
|---|---|---|---|---|
| 4,976,812 | A | 12/1990 | McConnell et al. | |
| 5,314,446 | A * | 5/1994 | Hunter et al. | 606/231 |
| 5,409,661 | A | 4/1995 | Head | |
| 5,468,327 | A * | 11/1995 | Pawlowicz et al. | 156/393 |
| 5,630,349 | A | 5/1997 | Farley | |
| 2002/0083820 | A1 * | 7/2002 | Greenhalgh | 87/8 |

FOREIGN PATENT DOCUMENTS

| | | | |
|---|---|---|---|
| DE | 42 34 979 | A1 | 4/1993 |
| DE | 42 43 465 | A1 | 7/1993 |
| DE | 101 16 953 | C2 | 10/2002 |
| EP | 0 628 401 | A1 | 12/1994 |
| FR | 1421657 | | 1/1976 |
| JP | 07 207557 | A | 8/1995 |
| WO | WO 92/15740 | A1 | 9/1992 |

OTHER PUBLICATIONS

International Search Report dated Aug. 30, 2005 with an English translation of the pertinent portions (Fifteen (15) pages).

* cited by examiner

*Primary Examiner*—Shaun R Hurley
(74) *Attorney, Agent, or Firm*—Crowell & Moring LLP

(57) ABSTRACT

Method of producing fiber composite semifinished products by means of a circular braiding technique, a braiding core being braided with braiding threads which are unwound by means of bobbins circling concentrically about the braiding core in different directions, characterized in that the bobbins of one circling direction are fitted with reinforcing threads and the bobbins of the opposite circling direction are at least partially fitted with supporting threads, the supporting threads at least partially consisting of thermoplastic threads.

11 Claims, 3 Drawing Sheets

METHOD FOR PRODUCING FIBER COMPOSITE SEMI-FINISHED PRODUCTS BY MEANS OF A ROUND BRAIDING TECHNIQUE

This application claims the priority of German patent document 10 2004 017 311.7, filed Apr. 6, 2004 (PCT International Application No. PCT/DE2005/000603, filed Apr. 6, 2005), the disclosure of which is expressly incorporated by reference herein.

BACKGROUND AND SUMMARY OF THE INVENTION

The present invention relates to a fiber composite semifinished product, and to a method of producing fiber composite semifinished products by means of a circular braiding technique.

Different methods of producing tube-shaped braidings (German Patent Document DE-A-42 34 979) or three-dimensional braidings (U.S. Pat. No. 5,630,349) are known. Because of the fact that braiding fibers are wound onto a braiding core, such circular braidings naturally have a so-called linen or body texture. This results in a waviness of the braiding fibers, such that the positive features of the fibers, specifically a high tensile and compressive stiffness or a high tensile and compressive strength, cannot be optimally utilized in a fiber composite material produced by a conventional braiding technique.

In addition, the known methods have the disadvantage that the braiding fibers are damaged or weakened by the shearing forces applied to them during the braiding or as a result of the friction at corresponding crossover points. These effects can be reduced, for example, by a braiding machine having two braiding rings (German Patent Document DE-C-101 15 935) carrying out periodic stroke movements. However, this arrangement still has the problem of the waviness of the fibers.

European Patent Document EP 0 628 401 A1 discloses a method for manufacturing a product (particularly a sports device) made of a fiber-reinforced thermoplastic resin, as well as a corresponding component, in which matrix-forming fibers and reinforcing fibers are woven or braided together.

International Patent Document WO 92/15740 A1 discloses an asymmetrical braiding for improving fiber-reinforced products.

One object of the present invention, therefore, is to provide a method of producing braided fiber composite semifinished products which reduces both the fiber damage and the waviness of the fibers, with improved characteristics of the material.

This and other objects and advantages are achieved by the production technique and the fiber composite semi-finished product according to the invention, which are based on the circular braiding technique, in which a braiding core is braided with braiding threads that are unwound by means of bobbins circling concentrically about the braiding core in different directions. According to the invention, the bobbins of one circling direction are fitted with reinforcing threads and the bobbins of the opposite circling direction are at least partially fitted with supporting threads, which are formed at least in part by thermoplastic threads.

By the braiding-in of thermoplastic threads (which, as known, consist of plastic materials, such as polyamides, polystyrenes, polyethylenes, polyesters, etc. that melt when heated over the softening point, and can be hot-formed, solidify again after cooling, and have good sliding characteristics) first, the friction of the mutually crossing braiding threads is reduced because the reinforcing threads slide off with reduced friction on the thermoplastic threads. This results in a clear reduction of the fiber damage, and therefore in an improvement of the material characteristics of the braiding.

Expediently, the supporting threads, formed at least partially of thermoplastic threads, hold the reinforcing threads deposited on the fiber core in position, so that the flexibility of the braiding process with respect to the braiding core geometry is simultaneously ensured. In this case, the elastic thermoplastic threads are placed so snugly between the reinforcing threads that the latter come to be situated in parallel virtually without any space in-between, and are therefore deposited almost without any waves. As a result of the accompanying reduced fiber waviness, the positive features of the reinforcing threads can be optimized, so that the material features of fiber composite semifinished products produced according to the invention are considerably improved.

Expediently, the braiding core is braided several times successively, with individual unidirectional reinforcing fiber layers being in each case deposited on the braiding core. The term "unidirectional" means that plane, not wavy individual layers are involved. This, in turn, has the advantage that the computability of the fiber construction of braidings produced according to the invention is improved because the mathematical models for unidirectional layouts can be applied. In addition, the thickness of such individual layers is reduced by approximately half in comparison to a braiding produced by means of a conventional braiding technique; that is, all bobbins are occupied by reinforcing threads.

It is another advantage that, during a layer-type braiding of the braiding core, before the depositing of another individual layer, the previously deposited individual layer can be fixed by melting the thermoplastic threads. As a result, sliding-out-of-place or displacement is prevented simply and effectively. The melting can be achieved, for example, by local heating or by the application of a vacuum hose with subsequent heating. In the latter case, the deposited individual layer is correspondingly consolidated, which further reduces the waviness of the braiding.

An asymmetrical bobbin occupation is expediently conceivable, during which the number of bobbins circling in one direction is unequal to the number of bobbins circling in the opposite direction, which ensures a great degree of variation. If, for example, reinforcing threads are placed on three quarters of the bobbins circling in one direction and thermoplastic threads are placed on one quarter of the bobbins circling in the opposite direction, one-and-a-half times the number of reinforcing threads can be processed in an individual layer. As a result, a depositing width is increased by 50%, and the braidable core circumference increases to the same extent. This has the advantage that correspondingly smaller and therefore less expensive machines can be used.

Typically, the reinforcing threads consist of carbon, glass, aramid and/or Kevlar fibers, which are characterized by high tensile and compressive stiffness as well as high tensile and compressive strength.

It is particularly advantageous that the supporting threads completely or at least partially dissolve at temperatures at which the braiding is normally infiltrated. Depending on the application, the supporting threads are made completely or at least partially of Grilon® threads or other thermoplastic threads with melting temperatures in the range of the infiltration temperature. In addition, the supporting threads may also be made of materials which are only partially liquescent.

However, as an alternative, thermoplastic threads can also be used which have a melting point above the typical infiltration temperature (such as polyester fibers). Such supporting threads do not dissolve in the matrix system of the infiltrated braiding, so that targeted feeding of supporting threads becomes possible, which may be advantageous for some applications.

The braided fiber composite semifinished products according to the invention, are made of a plurality of unidirectional individual layers, deposited layer by layer, each individual layer having braided-in supporting threads consisting at least partially of thermoplastic threads. By an appropriate selection of the supporting threads, special demands can be met advantageously, in a simple manner, so that the supporting threads in the infiltrated braiding are either completely or partially dissolved or are not dissolved at all.

Other objects, advantages and novel features of the present invention will become apparent from the following detailed description of the invention when considered in conjunction with the accompanying drawings.

DETAILED DESCRIPTION OF THE DRAWINGS

It is known that, during the braiding operation, bobbins, (that is, spool carriers which receive the braiding thread spools), are moved relative to one another on guideways, so that braid-forming thread crossovers are created. In circular braiding, the guideways follow two concentric circular paths in opposite directions about a core to be braided, such that the braiding threads of the bobbins in the positive rotating direction and those of the negative rotating direction cross over one another. Braiding is thus created when braiding around a three-dimensional braiding core.

Figure 1:
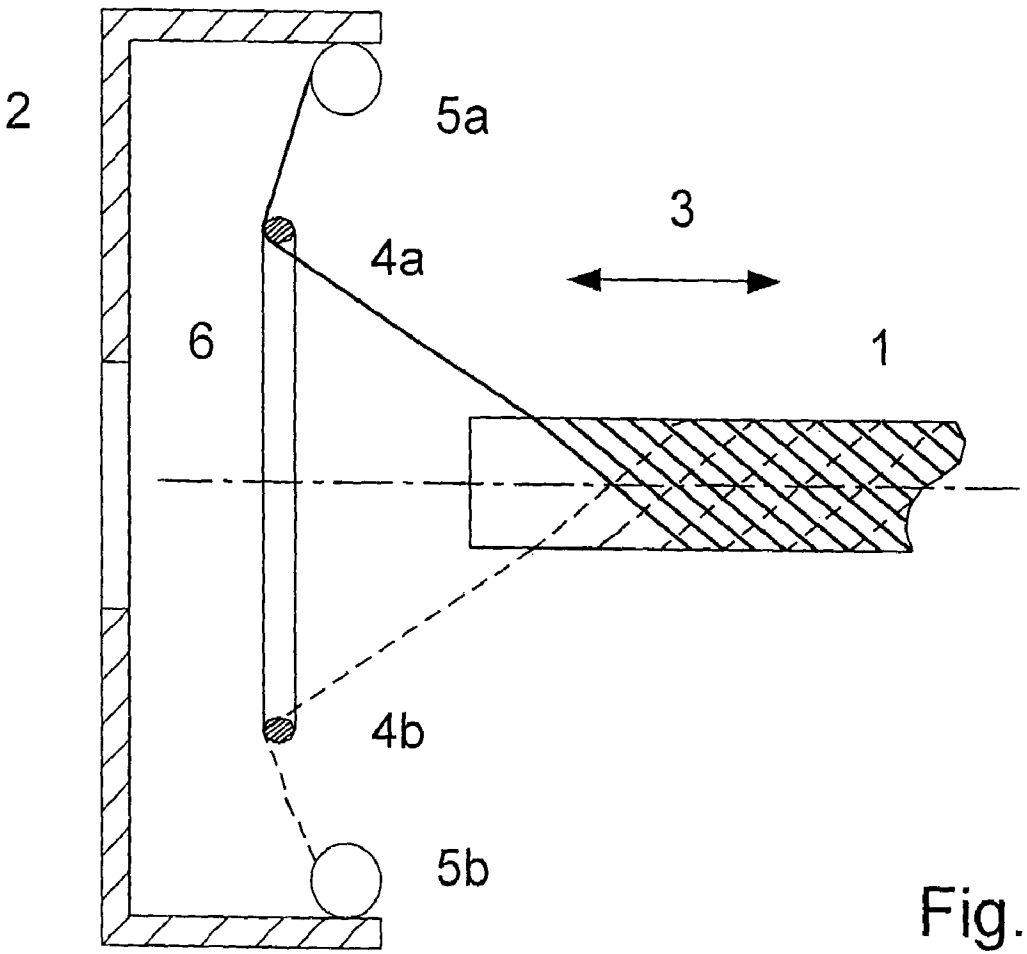
FIG. 1 is a schematic lateral view of the thread guidance on the braiding core.

FIG. 1 is a simplified lateral view of the thread guidance in the case of the method according to the invention. During the braiding, the braiding core 1 is moved in a known manner (for example, by means of a robot, not shown) relative to the stationary braiding machine body 2 in the direction of the movement arrow 3. The braiding threads 4*a*, 4*b* unwind from the bobbins 5*a* and 5*b* respectively and, after a deflection on the braiding ring 6, are deposited on the braiding core 1 by way of corresponding crossovers at the braiding points. In this case, the bobbins 5*a* and 5*b* have different circling directions about the fiber core 1. In order to simplify the drawing, FIG. 1 shows only two of the many additional braiding threads 4*a*, 4*b* and bobbins 5*a*, 5*b* respectively.

As schematically illustrated in FIG. 1, the bobbins 5*a* are fitted with reinforcing threads 4*a* made of carbon, glass, aramid and/or Kevlar fibers, and the bobbins 5*b* circling in the opposite direction are fitted with supporting threads 4*b* which consist at least partially of thermoplastic threads (such as Grilon® or polyester threads). For a better differentiation, the reinforcing threads 4*a* are indicated by solid lines in FIG. 1, and the supporting threads 4*b* are indicated by broken lines. Because of the good sliding characteristics of the thermoplastic threads, the friction is reduced during the deflection at the braiding ring 6 as well as at crossover points of the reinforcing threads 4*a* and the supporting threads 4*b*, which results in a clear reduction of the fiber damage. In addition, the reinforcing threads 4*a* are deposited without any waves, being held in position by the supporting threads 4*b*, so that the flexibility of the braiding process is maintained with respect to the core geometry, as in the case of conventional braiding techniques. In this case, the supporting threads 4*b* containing meltable elastic thermoplastic threads are placed so snugly between the reinforcing threads 4*a* that the latter come to be situated in parallel, with virtually no space in-between. In this manner, plane, not wavy individual layers (so-called unidirectional layers) are deposited on the braiding core 1, which improves the mathematical computability of the fiber construction of such braidings, because existing theoretical models for unidirectional layouts can be used.

For the construction of a fiber composite semifinished product, the braiding core 1 is braided several times successively by a corresponding back and forth movement of the braiding core 1 in the direction of the movement arrow 3, unidirectional individual layers being deposited in each case. It is expedient to carry out the braiding operation during the back as well as the forth movement, in order to avoid a new beginning of the braiding threads. Of course, the braiding operation can also take place in a single movement direction, in which case a new beginning of the braiding threads can be avoided, for example, by unwinding the braiding threads in the longitudinal direction of the braiding core 1.

As an alternative, before the deposit of another individual layer, the previously deposited individual layer can be prefixed by a melting of the braided-in thermoplastic threads, either by local heating or by applying a vacuum hose with subsequent heating. The latter has the advantage of further reducing the waviness.

Figure 2:
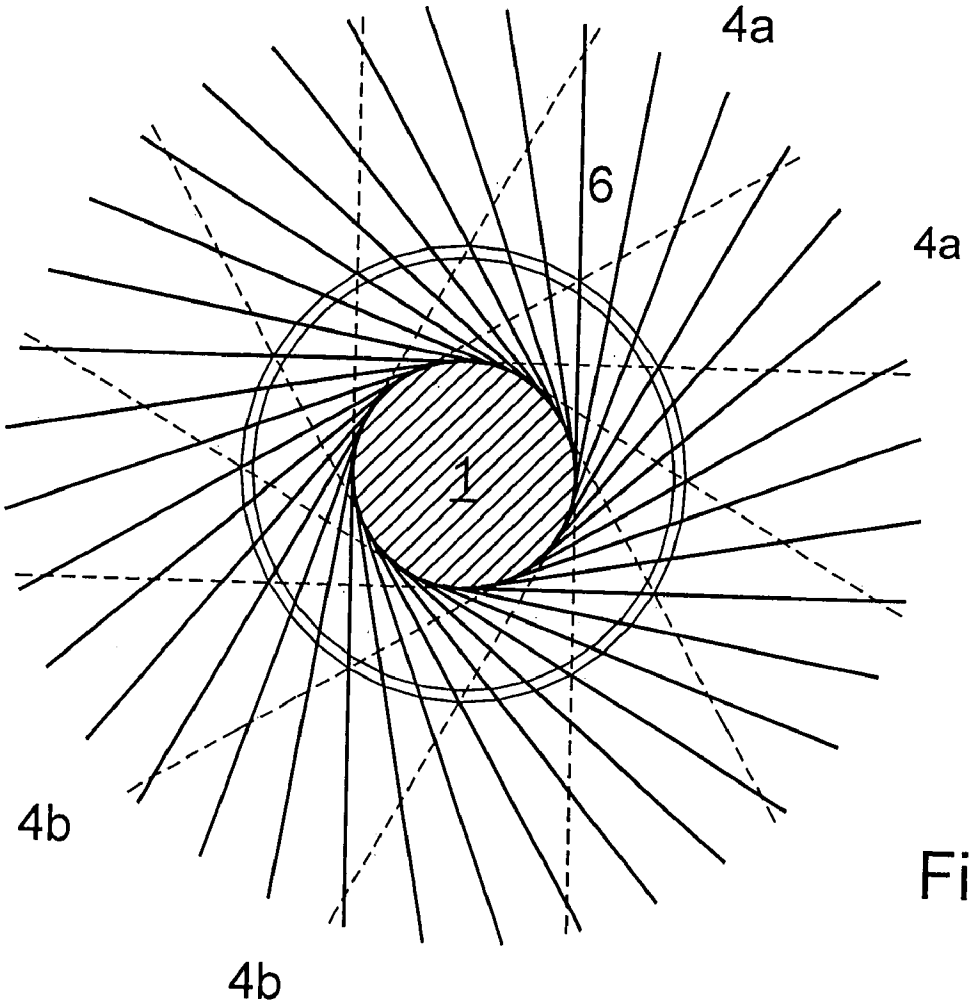
FIG. 2 is a schematic frontal view of the thread guidance on the braiding core.

FIG. 2 is a schematic frontal view of the thread guidance in the case of an asymmetrical occupation of the bobbins. For a better overview, the bobbins are not shown in FIG. 2. In the example of the arrangement according to FIG. 2, three quarters of the bobbins move counterclockwise about the braiding core 1 and are occupied by reinforcing threads 4*a*. The remaining bobbins, which move clockwise about the braiding core 1, are occupied by supporting threads 4*b* (illustrated by the broken line). In this manner, one-and-a-half times the number of reinforcing threads 4*a* can be processed in a unidirectional individual layer, which permits a depositing width increased by 50%. As a result, in the case of such a three quarters/one quarter occupation, a 144 bobbin machine would act like a conventionally operated machine with 216 bobbins, so that a correspondingly smaller and therefore more cost-effective machine could be used.

Figure 3:
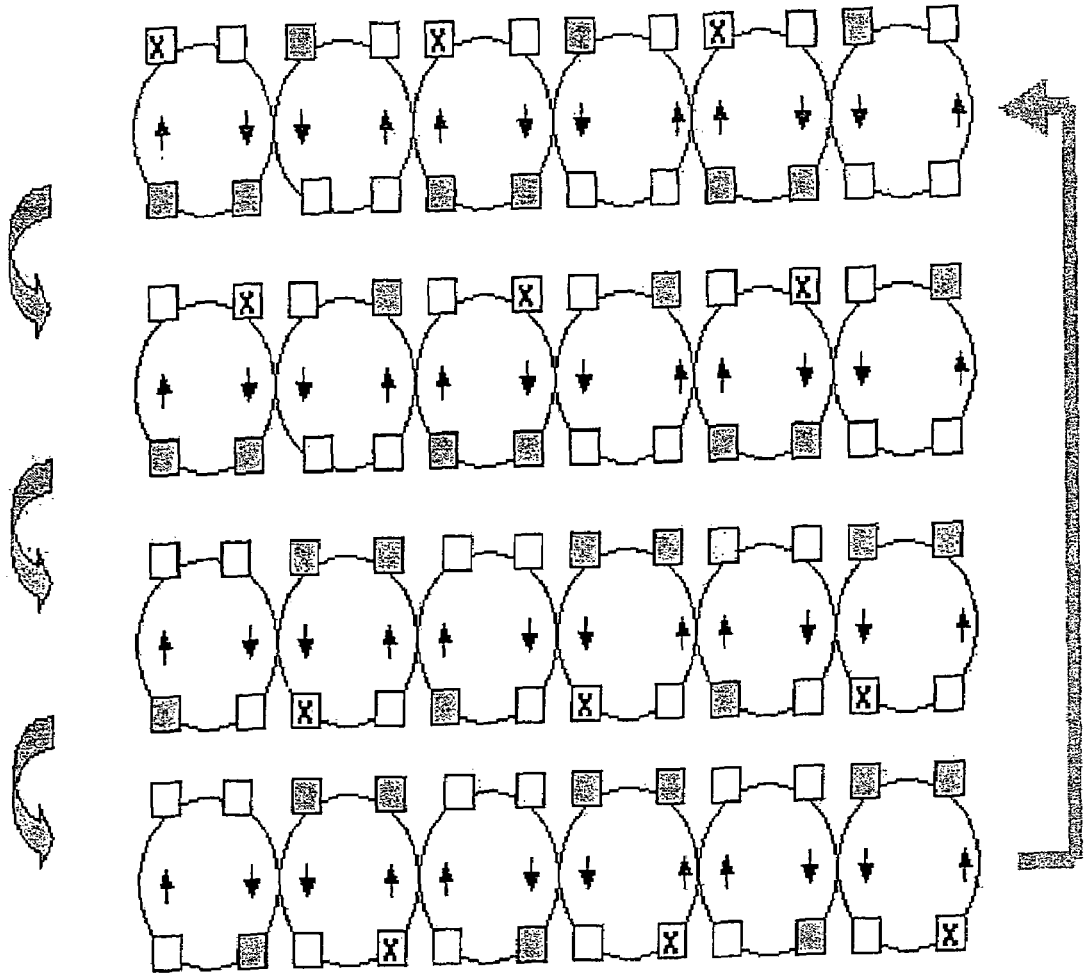
FIG. 3 is a schematic view of the occupation of the braiding machine for the depositing of reinforcing threads and supporting threads at a ratio of 3:1.

FIG. 3 is a schematic view of the occupation of the braiding machine for the depositing of reinforcing threads and supporting threads at the ratio of 3:1. Each horizontal row of FIG. 3 shows the position of the bobbins after a quarter rotation. The rectangles marked in gray represent the bobbins moving counterclockwise about the braiding core. The rectangles with the crosses represent bobbins moving clockwise, and the white rectangles represent vacant sites.

Of course, other occupation ratios of the bobbins can also be selected, and FIGS. 2 and 3 are used only for the explanation of an example.

According to the invention, braided fiber composite semifinished products therefore consist of a plurality of unidirectional individual layers deposited layer by layer. Each individual layer has braided-in supporting threads which are made at least partially of thermoplastic threads. If, for example, Grilon threads are used as the supporting threads (which have a melting temperature of approximately 85° C.), these dissolve during the infiltration of the braiding in the matrix system. However, if polyester threads are used, which have a melting point of above 180° C., they remain undissolved in the infiltrated braiding. In addition, supporting threads or compositions of supporting threads can be used which dissolve only partially when the braiding is infiltrated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method of producing fiber composite semifinished products by a circular braiding technique, comprising:

i) braiding threads onto a core by unwinding said threads from bobbins that circle concentrically about the core, in different directions;

ii) fitting the bobbins of a first circling direction with reinforcing threads; and iii) fitting the bobbins of an opposite circling direction at least partially with supporting threads that are made at least partially of melting threads; and iv) at least partially melting said melting threads by heating the threads which have been braided onto the core, to a temperature at which the braiding is infiltrated by a matrix system.

2. The method according to claim 1, wherein the reinforcing threads are held in position by the supporting threads.

3. The method according to claim 1 wherein:

said braiding step is repeated several times; and in each braiding, unidirectional individual layers are deposited on the braiding core.

4. A method of producing fiber composite semifinished products by a circular braiding technique, comprising:

braiding threads onto a core by unwinding said threads from bobbins that circle concentrically about the core, in different directions;

fitting the bobbins of a first circling direction with reinforcing threads; and fitting the bobbins of an opposite circling direction at least partially with supporting threads; wherein the supporting threads are made at least partially of melting threads;

said braiding step is repeated;

in each braiding, unidirectional individual layers are deposited on the braiding core; and before the depositing of another individual layer, a previously deposited individual layer is fixed by melting the melting threads.

5. The method according to claim 1, wherein a number of the bobbins circling in the first direction is unequal to the number of bobbins circling in the opposite direction.

6. The method according to claim 1, wherein at least one of carbon, glass, aramid and Kevlar fibers are used as reinforcing threads.

7. The method according to claim 1, wherein the supporting threads are made at least partially of Grilon® threads.

8. A braided fiber composite semifinished product, comprising a plurality of unidirectional reinforcing fiber layers, deposited layer by layer, wherein:

each individual layer has reinforcing threads and braided-in supporting threads made at least partially of melting threads; and said melting threads are at least partially in a melted state such that each layer is consolidated.

9. The braided fiber composite semifinished product according to claim 8, wherein the supporting threads are at least partially meltable when the braiding is infiltrated in a matrix system.

10. The braided fiber composite semifinished product according to claim 9, wherein the supporting threads are made at least partially of Grilon® threads.

11. A method of producing fiber composite semifinished products by a circular braiding technique, comprising:

depositing a plurality of unidirectional reinforcing fiber layers onto a braiding core; and heating said layers;

wherein said depositing step comprises, i) braiding threads onto a core by unwinding said threads from bobbins that circle concentrically about the core, in different directions;

ii) fitting the bobbins of a first circling direction with reinforcing threads; and iii) fitting the bobbins of an opposite circling direction at least partially with supporting threads that are made at least partially of melting threads; and iv) repeating step i) at least once;

wherein said heating step comprises heating said layers to a temperature at which said melting threads melt at least partially.

* * * * *